US011835926B1

(12) United States Patent
De La Garza

(10) Patent No.: US 11,835,926 B1
(45) Date of Patent: Dec. 5, 2023

(54) WATCH COVER

(71) Applicant: Juan Manuel Trevino De La Garza, Grapevine, TX (US)

(72) Inventor: Juan Manuel Trevino De La Garza, Grapevine, TX (US)

( * ) Notice: Subject to any disclaimer, the term of this patent is extended or adjusted under 35 U.S.C. 154(b) by 0 days.

(21) Appl. No.: 18/457,203

(22) Filed: Aug. 28, 2023

(51) Int. Cl.
*G04B 45/00* (2006.01)
*G04B 37/12* (2006.01)
*G04B 47/04* (2006.01)

(52) U.S. Cl.
CPC ..... *G04B 45/0076* (2013.01); *G04B 37/127* (2013.01); *G04B 47/046* (2013.01)

(58) Field of Classification Search
CPC . G04B 45/0076; G04B 37/127; G04B 47/046
See application file for complete search history.

(56) References Cited

U.S. PATENT DOCUMENTS 3,739,740 A * 6/1973 Fromer ..... G04B 47/003 206/459.1
5,206,841 A * 4/1993 Boucheron ..... G04B 37/005 368/283
5,802,014 A * 9/1998 Danko ..... A61J 7/0481 368/282
6,464,389 B1 * 10/2002 Ghoorahoo ..... G04B 37/127 368/278
9,913,465 B2 * 3/2018 Metzger ..... A01M 29/12
10,076,468 B2 * 9/2018 Ohl ..... G16H 20/13
2008/0151695 A1 * 6/2008 Kimel ..... G04G 17/08 368/10
2011/0205859 A1 * 8/2011 Durpetti ..... A61K 33/06 368/285

* cited by examiner

*Primary Examiner* — Edwin A. Leon
*Assistant Examiner* — Jason M Collins
(74) *Attorney, Agent, or Firm* — Ruben Alcoba, Esq.

(57) ABSTRACT

A watch cover that covers the face of a watch. The watch cover has a plurality of receivers around the circumference of the watch cover. The plurality of receivers receive either a plastic or a glass capsule that snaps into the plurality of receivers. The plastic or the glass capsules have removable caps that allow the plastic or glass capsules to be filled with either a liquid or solid material prior to the plastic or the glass capsules being snapped into the plurality of receivers. The watch cover can have two wrist bands that attach to the watch cover. The wrist bands will have a plurality of wrist receivers throughout the length of the wrist bands. The wrist receivers will receive either the plastic or the glass capsules after they are filled with the liquid or the solid materials.

11 Claims, 3 Drawing Sheets

WATCH COVER

TECHNICAL FIELD

The present invention is directed to a watch cover.

BACKGROUND

The present invention was conceived by the inventor to bring a natural aspect of the physical world into his time pieces.

The inventor of the present invention believes that by being able to place the natural materials within a watch that he can harness a memory from his travels into his timepieces.

In the same manner, he also believes that placing a combination of materials into his timepieces that he can have a unique watch that he can dress at his convenience. It is foreseen that the materials can be either medicines, vitamins, or minerals.

He also believes that he can dress his watches with liquids that can remind him of his travels.

The materials or liquids that he will place into the watch covers will be stored within refillable clear capsules that can be refiled by the user.

The present invention provides a watch cover that can be used to store liquids or solid materials.

SUMMARY

A watch cover that covers the face of a watch. The watch cover has a plurality of receivers around the circumference of the watch cover. The plurality of receivers receive either a plastic or a glass capsule that snaps into the plurality of receivers. The plastic or the glass capsules have removable caps that allow the plastic or glass capsules to be filled with either a liquid or solid material prior to the plastic or the glass capsules being snapped into the plurality of receivers. The watch cover can have two wrist bands that attach to the watch cover. The wrist bands will have a plurality of wrist receivers throughout the length of the wrist bands. The wrist receivers will receive either the plastic or the glass capsules after they are filled with the liquid or the solid materials.

An object of the present invention is to provide a watch cover that can be placed over the face of a watch.

Another object of the present invention is to provide a watch cover that can be used to carry memories of places visited throughout the life of the user.

Yet another object of the present invention is to provide a watch cover that can allow a user to carry a liquid or a solid materials within capsules that are snapped into the watch cover.

Still another object of the present invention is provide a watch cover that be selectively designed by the user of the watch cover.

BRIEF DESCRIPTION OF THE DRAWINGS

These and other features, aspects, and advantages of the present invention will become better understood with regards to the following description, appended claims, and drawings where:

DESCRIPTION

Figure 1:
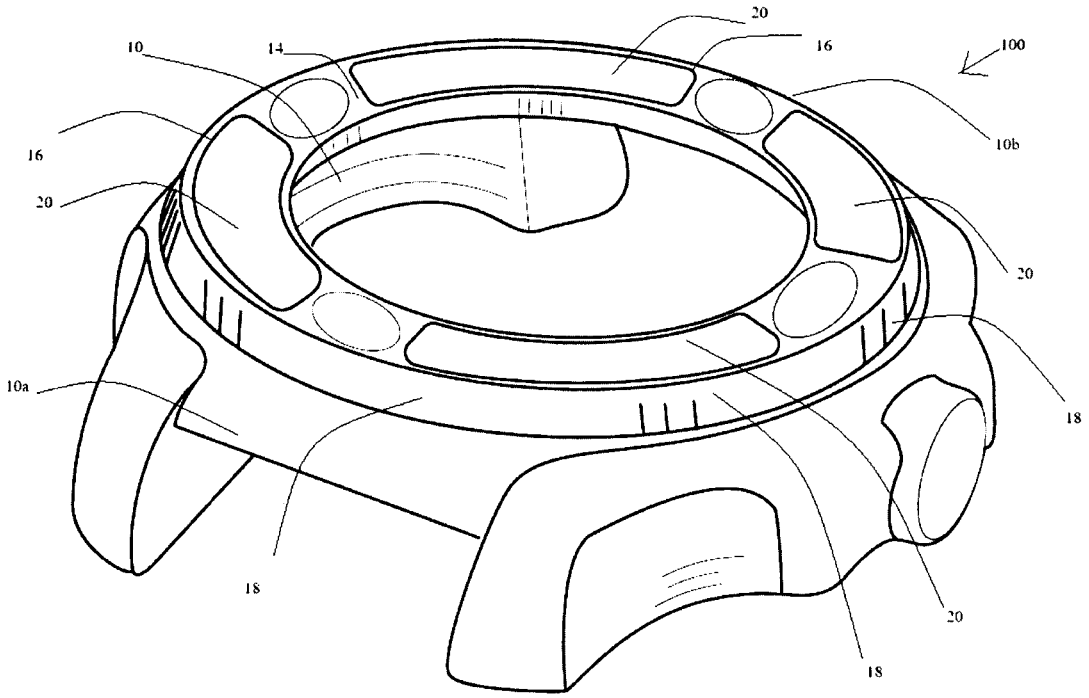
FIG. 1 is a perspective view of the present invention.
Figure 2:
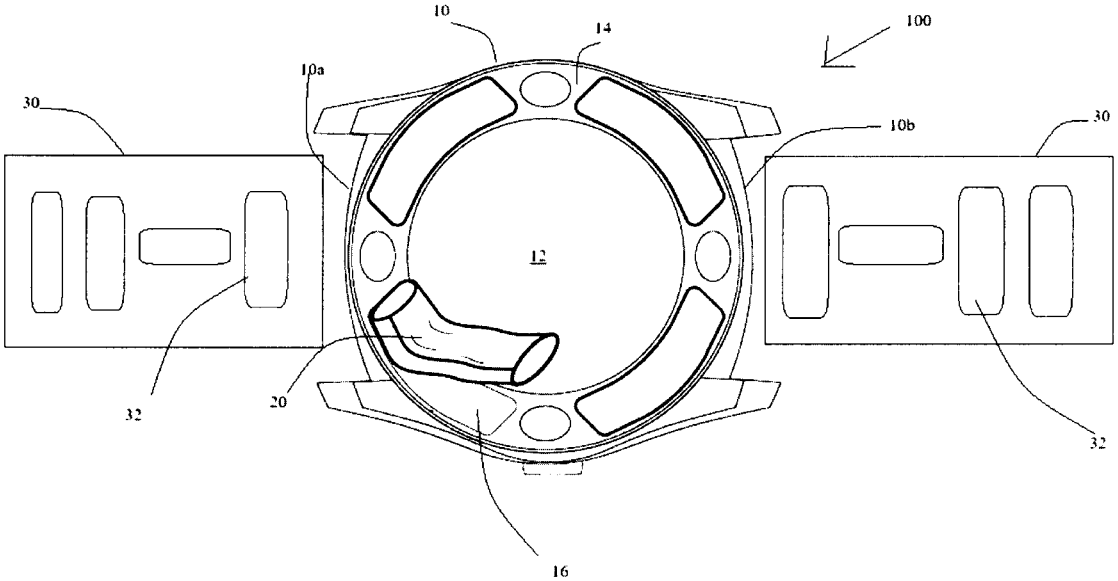
FIG. 2 is a top plan view of the present invention.
Figure 3:
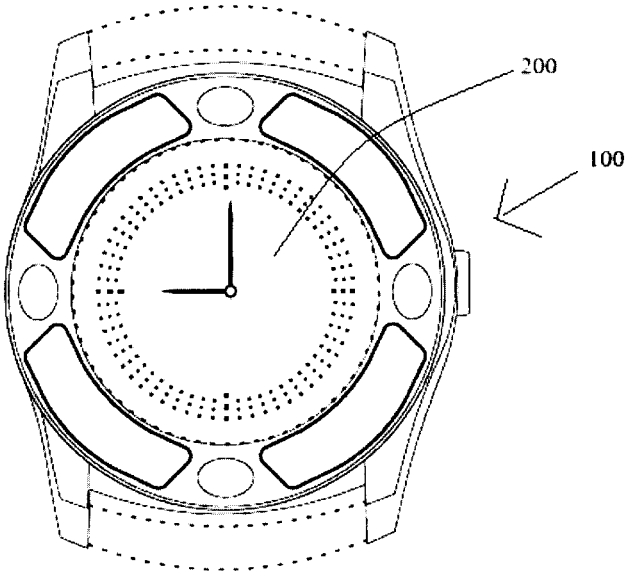
FIG. 3 is a top plan view of the present invention when it is mounted on a watch.
Figure 4:
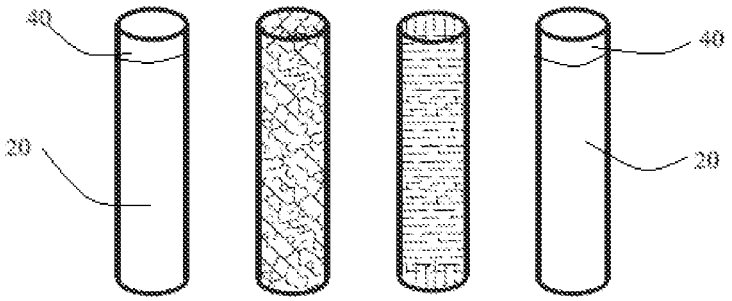
FIG. 4 is a front view of the plurality of capsules of the present invention.

As seen in FIGS. 1-4, the present invention is a watch cover 100 that covers a face of a watch 200. The watch cover 100 comprises a cover 10 that defines an inner aperture 12 that is configured to allow the face of a watch 200 to be seen. The cover 10 has a top border 14, the top border 14 defines a plurality of snap-in receivers 16 throughout a circumference of the top border 14. The cover 14 has a side wall 18 that runs downward from an outer circumference 17 of the top border 14, the side wall 18 is configured to snap over the watch 200. And, a plurality of capsules 20 that snap into the plurality of snap-in receivers 16, the plurality capsules 20 are filled with either a liquid or a solid material prior to being snapped into the plurality of snap-in receivers 16.

In an embodiment of the present invention the watch cover 100 comprises a pair of wrist bands 30 that attach to the left 10*a* and right sides 10*b* of the cover 14, the wrist bands define a plurality of snap-in receivers 32 that are configured to receive the plurality of capsules 20, and the plurality of capsules 20 snap-into the plurality of snap-in receivers 32 after the plurality of capsules 20 are filled with either the liquid or the solid material.

In another embodiment of the present invention the plurality of capsules 20 have a removable cap 40.

In embodiments of the present invention, the liquid material is a blessed liquid.

In other embodiments of the present invention, the solid material is a medicine.

In still other embodiments of the present invention, the solid material is either a vitamin or a mineral.

In preferred embodiments of the present invention, the plurality of capsules will be made of a bendable plastic material.

An advantage of the present invention is that it provides a watch cover that is placed over the face of a watch.

Another advantage of the present invention is that it provides a watch cover that is used to carry memories of places visited throughout the life of the user.

Yet another advantage of the present invention is that it provides a watch cover that allows a user to carry a liquid or a solid materials within capsules that are snapped into the watch cover.

Still another object of the present invention is provide a watch cover that be selectively designed by the user of the watch cover.

The embodiments of the watch cover described herein are exemplary and numerous modifications, combinations, variations, and rearrangements can be readily envisioned to achieve an equivalent result, all of which are intended to be embraced within the scope of the appended claims. Further, nothing in the above-provided discussions of the watch cover should be construed as limiting the invention to an embodiment or a combination of embodiments. The scope of the invention is defined by the description, drawings, and claims.

What is claimed is:

1. A watch cover that covers a face of a watch, the watch cover comprises:

a cover that defines an inner aperture that is configured to allow the face of a watch to be seen, the cover has a top border, the top border defines a plurality of snap-in receivers throughout a circumference of the top border, the cover has a side wall that runs downward from an outer circumference of the top border, the side wall is configured to snap over the watch; and a plurality of capsules that snap into the plurality of snap-in receivers, the plurality of capsules are filled with either a liquid or a solid material prior to being snapped into the plurality of snap-in receivers.

2. The watch cover that covers the face of the watch of claim 1, the watch cover comprises a pair of wrist bands that attach to the left and right sides of the watch cover, the wrist bands define a plurality of snap-in receivers that are configured to receive the plurality of capsules, and the plurality of capsules snap-into the plurality of snap-in receivers after the plurality of capsules are filled with either the liquid or the solid material.

3. The watch cover that covers the face of the watch of claim 2, wherein the plurality of capsules have a removable cap.

4. The watch cover that covers the face of the watch of claim 3, wherein the liquid material is a blessed liquid.

5. The watch cover that covers the face of the watch of claim 4, wherein the solid material is a medicine.

6. The watch cover that covers the face of the watch of claim 4, wherein the solid material is either a vitamin or a mineral.

7. The watch cover that covers the face of the watch of claim 1, wherein the plurality of capsules have a removable cap.

8. The watch cover that covers the face of the watch of claim 7, wherein the liquid material is a blessed liquid.

9. The watch cover that covers the face of the watch of claim 8, wherein the solid material is a medicine.

10. The watch cover that covers the face of the watch of claim 9, wherein the solid material is either a vitamin or a mineral.

11. The watch cover that covers the face of the watch of claim 1, wherein the plurality of capsules are made of a bendable plastic.

* * * * *